US011098887B1

(12) United States Patent
Irons

(10) Patent No.: US 11,098,887 B1
(45) Date of Patent: Aug. 24, 2021

(54) ENCAPSULATED LINEAR LIGHTING

(71) Applicant: Elemental LED, Inc., Reno, NV (US)

(72) Inventor: Travis Irons, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/117,410

(22) Filed: Dec. 10, 2020

(51) Int. Cl.

| | |
|---|---|
| ***F21V 31/04*** | (2006.01) |
| ***F21S 4/22*** | (2016.01) |
| ***F21Y 115/10*** | (2016.01) |
| ***F21Y 103/10*** | (2016.01) |
| ***F21S 4/28*** | (2016.01) |

(52) U.S. Cl.
CPC ..... *F21V 31/04* (2013.01); *F21S 4/22* (2016.01); *F21S 4/28* (2016.01); *F21Y 2103/10* (2016.08); *F21Y 2115/10* (2016.08)

(58) Field of Classification Search
CPC ..... F21V 31/04; F21S 4/20; F21S 4/22; F21S 4/24; F21S 4/26; F21S 4/28; F21Y 2103/10; F21Y 2115/10
See application file for complete search history.

(56) References Cited

U.S. PATENT DOCUMENTS

| | | | | |
|---|---|---|---|---|
| 6,914,194 | B2 * | 7/2005 | Fan | F21S 4/24 174/117 F |
| 7,213,941 | B2 | 5/2007 | Sloan et al. | |
| 8,262,250 | B2 * | 9/2012 | Li | F21V 23/06 362/219 |
| 8,322,883 | B2 | 12/2012 | Cleaver et al. | |
| 8,684,558 | B2 * | 4/2014 | Hsu | F21S 4/28 362/249.04 |
| 10,078,180 | B1 | 9/2018 | Wasserman et al. | |
| 10,520,143 | B1 | 12/2019 | Findlay et al. | |
| 10,524,320 | B1 * | 12/2019 | Irons | F21V 23/002 |
| 10,582,616 | B1 * | 3/2020 | Chen | H05K 1/144 |
| 10,619,828 | B2 | 4/2020 | Tremaine et al. | |
| 10,753,596 | B1 | 8/2020 | Lopez-Martinez et al. | |
| 10,775,005 | B2 * | 9/2020 | Van Montfort | H01L 33/60 |
| 10,801,716 | B1 | 10/2020 | Lopez-Martinez et al. | |
| 2005/0094392 | A1 * | 5/2005 | Mooney | H05K 1/0274 362/241 |

(Continued)

FOREIGN PATENT DOCUMENTS

| | | | | |
|---|---|---|---|---|
| CA | 3018832 | A1 * | 9/2017 | A47F 11/10 |
| DE | 102007006440 | A1 * | 8/2007 | F21K 9/00 |

(Continued)

OTHER PUBLICATIONS

Michael Titze, Description DE102012110136A1, Apr. 2014, Patent Translate Powered by EPO and Google, pp. 1-9.*

(Continued)

*Primary Examiner* — Alan B Cariaso
(74) *Attorney, Agent, or Firm* — United IP Counselors, LLC

(57) ABSTRACT

Encapsulated linear lighting with improved light diffusion is disclosed. The encapsulated linear lighting includes a channel and a long narrow strip of printed circuit board (PCB) with light engines disposed off-center on the PCB. The PCB is installed along a bottom inner surface of a sidewall of the channel so that the light engines are adjacent a bottom of the channel. The encapsulated linear lighting includes a covering that encapsulates and protects the PCB.

9 Claims, 3 Drawing Sheets

(56) References Cited

U.S. PATENT DOCUMENTS

| | | | | |
|---|---|---|---|---|
| 2015/0198289 | A1* | 7/2015 | Hsu | F21S 4/26 362/225 |
| 2019/0049077 | A1* | 2/2019 | Corvese | F21S 4/24 |
| 2019/0242538 | A1* | 8/2019 | Zeng | F21V 29/70 |
| 2020/0149716 | A1* | 5/2020 | Collado | F21V 33/006 |

FOREIGN PATENT DOCUMENTS

| | | | | |
|---|---|---|---|---|
| DE | 102012110136 | A1 * | 4/2014 | F21S 4/22 |
| EP | 3418621 | A1 * | 12/2018 | F21S 4/28 |

OTHER PUBLICATIONS

Wolf-Dietrich Hannecke, Description DE102007006440A1, Aug. 2007, Patent Translate Powered by EPO and Google, pp. 1-10.*

* cited by examiner

ENCAPSULATED LINEAR LIGHTING

TECHNICAL FIELD

The invention relates to encapsulated linear lighting.

BACKGROUND

Linear lighting is a particular class of solid-state lighting that uses light-emitting diodes (LED). In this type of lighting, a long, narrow printed circuit board (PCB) is populated with LED light engines, usually spaced at a regular pitch or spacing and centrally positioned with respect to the width of the PCB. The PCB may be either rigid or flexible, and other circuit components may be included on the PCB, if necessary. Depending on the type of LED light engine or engines that are used, the linear lighting may emit a single color, or may be capable of emitting multiple colors.

In combination with an appropriate power supply or driver, linear lighting is considered to be a luminaire in its own right, and it is also used as a raw material for the production of more complex luminaires, such as light-guide panels. In practice, strips of PCB may be joined together in the manufacturing process to produce linear lighting of essentially any length. Spools of linear lighting 30 meters (98 ft) in length are common, and spools of linear lighting 100 meters (328 ft) in length are commercially available.

Fundamentally, linear lighting is a microelectronic circuit. That circuit is susceptible to physical damage. Therefore, manufacturers have sought ways to make linear lighting more robust and more resistant to damage from physical impact and ingress of water and other debris. A popular way to protect linear lighting is to encapsulate it within a polymer resin. U.S. Pat. No. 10,801,716 to Lopez-Martinez et al., the contents of which are incorporated by reference herein in their entirety, discloses exemplary methods of encapsulating linear lighting by installing linear lighting along the bottom of a channel and then filling the channel with a resin. However, merely encapsulating typical linear lighting does not always produce desired light output.

In some applications, it is desirable for light from encapsulated linear lighting to appear as a single, continuous line of light, instead of as a series of bright spots. Such light output may be achieved by diffusing light emitted from multiple LED light engines. To that end, encapsulating material may include diffusing additives or multiple layers of material with different optical properties to refract and diffuse light emitted from multiple LED light engines. The amount of light diffusion that can be achieved, though, may be limited by the short distance traveled by the light before being emitted from encapsulated linear lighting.

BRIEF SUMMARY

One aspect of the invention relates to encapsulated linear lighting with light engines positioned in a channel to improve light diffusion. The encapsulated linear lighting includes a long, narrow strip of printed circuit board (PCB) with light engines disposed on the PCB. The PCB is positioned along a sidewall of the channel and oriented to position the light engines adjacent a bottom of the channel. The encapsulated linear lighting includes a covering that encapsulates and protects the PCB.

Another aspect of the invention relates to linear lighting for use in encapsulation. In linear lighting according to this aspect of the invention light engines are disposed off-center on a long, narrow strip of PCB. More specifically, the light engines are disposed away from a center line that extends longitudinally along the PCB. Typically, the light engines are disposed adjacent a lateral edge of the PCB. The light engines are top-emitting, configured to emit light in a direction normal to the surface of the PCB on which they are mounted. When this PCB is installed adjacent to the bottom of the channel during an encapsulation process, the position of the light engines on the PCB maximizes the distance that the light travels from the light engines before it is emitted, and may thus improve the diffusion Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
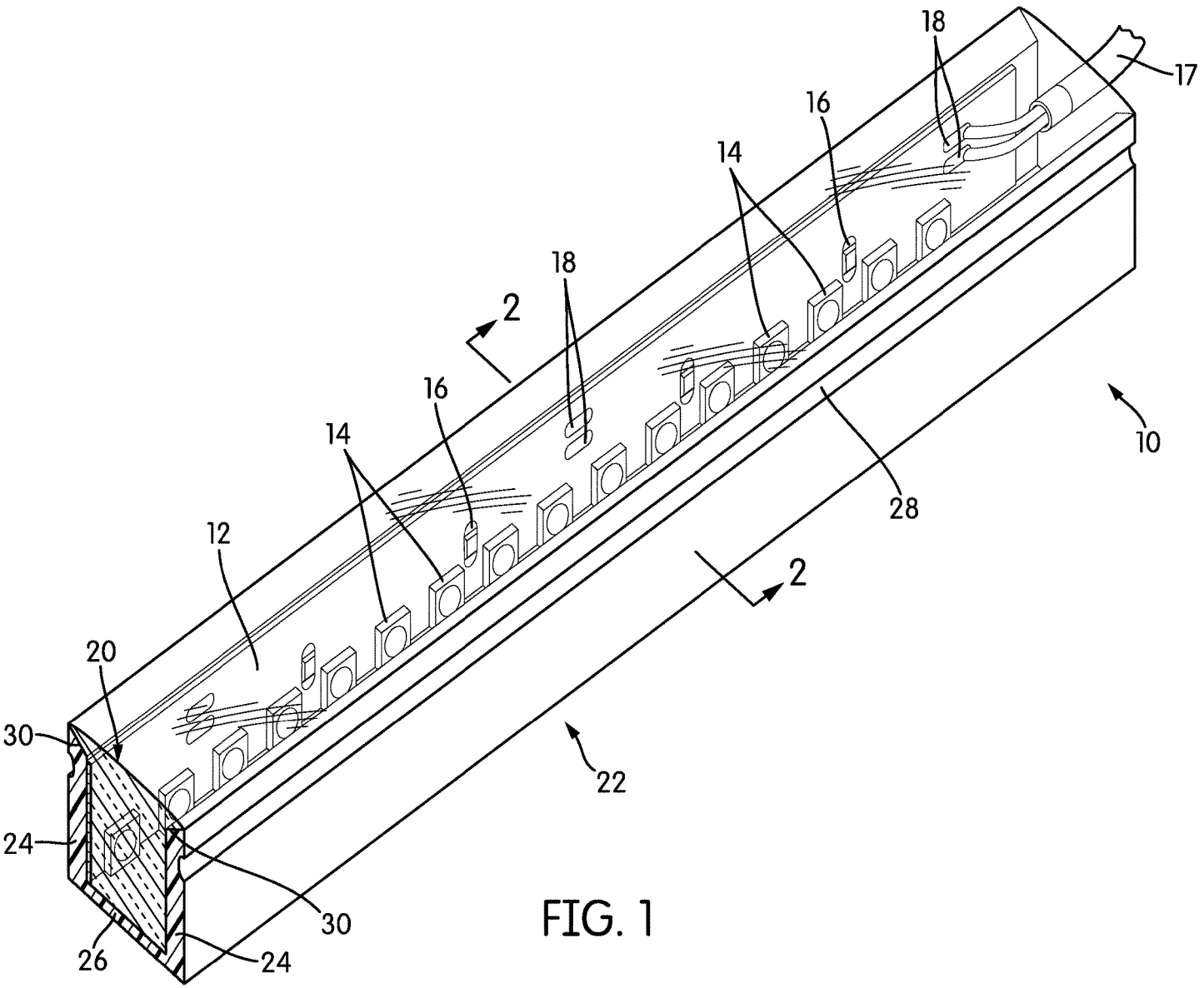
FIG. 1 is a perspective view of a strip of encapsulated linear lighting according to one embodiment of the invention.

FIG. 1 is a perspective view of a strip of encapsulated linear lighting, generally indicated at 10, according to one embodiment of the invention. The encapsulated linear lighting 10 includes a strip of linear lighting, a long, narrow printed circuit board 12 (PCB) with a plurality of LED light engines 14 disposed thereon. PCB 12 and LED light engines 14 are encapsulated with a covering 20, as will be described in greater detail below. As will also be explained in further detail below, light engines 14 have an unusual placement on PCB 12: they are located adjacent an edge of PCB 12.

As the term is used here, "light engine" refers to an element in which one or more light-emitting diodes (LEDs) are packaged, along with wires and other structures, such as electrical contacts, that are needed to connect the light engine to a PCB. LED light engines may emit a single color of light, or they may include red-green-blue (RGBs) LEDs that, together, are capable of emitting a variety of different colors depending on the input voltages. If the light engine is intended to emit "white" light, it may be a so-called "blue pump" light engine in which a light engine containing one or more blue-emitting LEDs (e.g., InGaN LEDs) is covered with a phosphor, a chemical compound that absorbs the emitted blue light and re-emits either a broader or a different spectrum of wavelengths. The particular type of LED light engine is not critical to the invention. In the illustrated embodiment, the light engines are surface-mount devices (SMDs) soldered to PCB 12, although other types of light engines may be used.

To make a functional strip of encapsulated linear lighting 10, a component or components are included to set the current level in the circuit. This may be done in the power supply, or it may be done by adding components directly to PCB 12 to manage current flow. Linear lighting that is designed to control the current flow using circuit components disposed on PCB 12 is often referred to as "constant voltage" linear lighting. Linear lighting that requires the power supply to control the current flow is often referred to as "constant current" linear lighting. Constant-current linear lighting is often used when the length of the linear lighting is known in advance; constant-voltage linear lighting is more versatile and more easily used in situations where the length, and resulting current draw, is unknown or is likely to vary from one installation to the next.

In the illustrated embodiment, the encapsulated linear lighting 10 is constant voltage and the current-setting components 16 are resistors. For example, 0805 surface-mount resistors may be used. In other embodiments, current-source integrated circuits may be used, or a combination of current-source integrated circuits and resistors may be used. In many cases, more current-setting components 16 are used than are strictly necessary, spaced from one another along PCB 12. This is because current-setting components 16 typically generate heat and providing more current-setting components 16 at a greater pitch may help with heat management.

Generally speaking, linear lighting may accept either high voltage or low voltage. While the definitions of "high voltage" and "low voltage" may vary depending on the authority one consults, for purposes of this description, "high voltage" should be construed to refer to any voltage over about 50V. High voltage typically brings with it certain enhanced safety and regulatory requirements. Encapsulated linear lighting 10 may be either high-voltage or low-voltage, although certain portions of this description may relate specifically to low-voltage linear lighting.

At one end, a jacketed power cable 17 brings power to PCB 12 and is connected to PCB 12 by appropriate means, such as by soldering to solder pads 18 that are provided on PCB 12. However, other suitable forms of connectors and terminal blocks may also be used.

PCB 12 and a portion of power cable 17 are fully encapsulated in the illustrated embodiment, meaning that a covering 20 surrounds these components. Covering 20 provides a high degree of ingress protection, and depending on the polymer, may confer an ingress protection rating of IP68 or higher. While the covering may be completely solid with no gaps, in practice, there may be gaps and other features within covering 20. For example, covering 20 may include an air gap over PCB 12 or other such features in order to modify or control the emission of light out of encapsulated linear lighting 10.

Covering 20 may be either rigid or flexible. PCB 12 itself may be either flexible or rigid as well. As those of skill in the art will understand, definitions of the terms "flexible" and "rigid" may be complex, contextual, and variable. For purposes of this description, it is sufficient to say that covering 20 may have a range of possible durometer hardnesses, elastic moduli, and other mechanical properties. As one example of "flexible" and "rigid," the SEPUR 540 RT/DK 100 HV two-part polyurethane system (Special Engines S.r.l., Torino, Italy) has a durometer hardness of 68-75 Shore A at room temperature according to the ASTM D 2240 test standard, and may be considered flexible for these purposes, while the similar SEPUR 540 RT/DK 180 HV two-part polyurethane system has a durometer hardness of 75-78 Shore A, and may be considered rigid for these purposes. Ultimately, anything that can provide a degree of protection for PCB 12 may be used.

Covering 20 may comprise a variety of materials or additives to produce a desired light for a particular application. For example, covering 20 may be a silicone polymer, a polyurethane polymer, or some other type of polymer system, as described in U.S. Pat. No. 10,801,716. Covering 20 may be translucent and may include additional materials or additives for the sake of diffusion, although FIG. 1 shows a largely transparent covering merely for ease in explanation. Moreover, while covering 20 is described here as a singular, unitary thing, it may be constructed using multiple parts and layers during the encapsulation process.

In one embodiment, PCB 12 is installed in a channel 22 including sidewalls 24 extend upwardly from a bottom 26. Channel 22 may have external features that allow encapsulated linear lighting 10 to be used with mounting clips, channels, and other accessories that allow for mounting. In the illustrated embodiment, channel 22 has a rounded groove 28 that runs the length of channel 22 along the upper portion of each sidewall 24.

In an exemplary method of forming encapsulated linear lighting 10, channel 22 receives a fill material to encase PCB 12 and form covering 20. Covering 20 provides protection to PCB 12 by limiting ingress of material into channel 22. Channel 22 and covering 20 would typically be made of the same material, or at least, the same type of material. For example, channel 22 and covering 20 may be made with the same two-part polyurethane or silicone resin system. In some cases, channel 22 may be made of the same polymer or polymer system as covering 20 but could have colorants or other additives relative to covering 20. For example, channel 22 could be colored white for reflectivity, or could include a ceramic, metallic, or other filler for heat conductivity. As may be apparent from the description above, if channel 22 and covering 20 are made from the same polymer with the same additives, their appearance would typically be the same, and it may be difficult or impossible to distinguish between channel 22 and covering 20 in the finished product.

Figure 2:
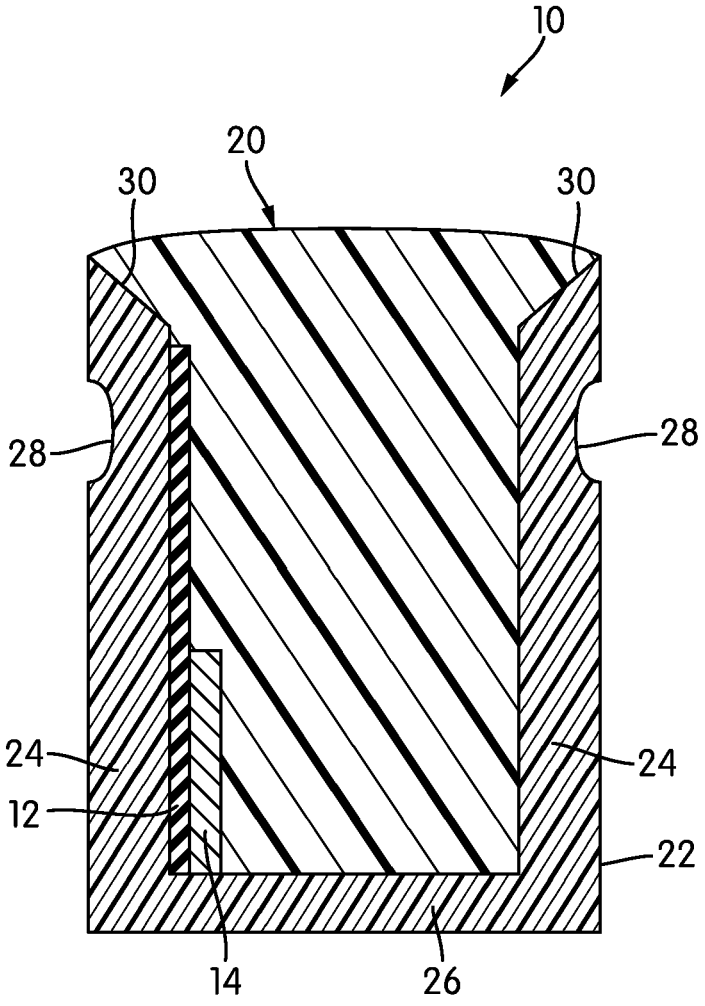
FIG. 2 is a cross-sectional view of the strip of encapsulated linear lighting of FIG. 1.

FIG. 2 is a cross-sectional view of encapsulated linear lighting 10. In the illustrated embodiment, each sidewall 24 includes an angled top 30, and covering 20 assumes a convex, domed appearance at angled tops 30. During encapsulation of linear lighting 10, fill material deposited into channel 22 may assume the slightly convex, domed appearance due to surface tension in the fill material. The final shape of the top of covering 20 may be adjusted during the manufacturing process based on a number of factors, including properties of the fill material, the amount of fill material deposited, and the angle of tops 30. In some applications, the shape of covering 20, and particularly, the shape of its top, may allow covering 20 to act as a lens for light emitted from light engines 14. In other embodiments, the top of covering 20 may assume a substantially flat shape.

As can be seen in FIGS. 1 and 2, PCB 12 is installed within channel 22 along a bottom interior surface of one sidewall 24. With PCB 12 positioned along sidewall 24, encapsulated linear lighting 10 is configured as "side-bend" encapsulated linear lighting. As used here, the term "side-bend" refers to the fact that the encapsulated linear lighting bends in a single plane that is perpendicular to a line normal to its bottom. With respect to the coordinate system of FIG. 2, the encapsulated linear lighting 10 bends to the left and right. A more detailed description of side-bend linear lighting may be found in U.S. Pat. No. 10,520,143 to Findlay et al., and this patent is incorporated by reference to the extent that it explains side-bend versus top-bend linear lighting. Reducing the overall width of channel 22 may improve the flexibility of channel 22 in the single bending plane of encapsulated linear lighting 10. PCB 12 may bend with sidewall 24 in the bending plane. Bending in other planes may damage PCB 12.

PCB 12 is constructed such that light engines 14 are located off-center on PCB 12. When PCB 12 is installed as shown in FIG. 2, light engines 14 are positioned adjacent bottom 26 of channel 22. In the illustrated embodiment, PCB 12 contacts bottom 26 so as to position light engines 14 as close to bottom 26 as is feasible. In some embodiments, light engines 14 may contact bottom 26.

Installing PCB 12 adjacent bottom 26 positions light engines 14 away from the top of encapsulated linear lighting 10 to improve diffusion of light emitted from light engines 14. Without intending to be limited to a particular theory, light diffusion increases as the light travels farther from its source. As will be apparent from the following description, light emitted from light engines 14 on PCB 12 positioned according to the illustrated embodiment travels a greater distance than if PCB 12 were installed along bottom 26.

In the illustrated embodiment, light engines 14 are configured as "top-emitting" LED light engines that emit light away from and in a direction normal to the surface of PCB 12 on which they are mounted. The light emission from light engines 14 is typically Lambertian, that is, it conforms to Lambert's cosine law. In other words, light emitted from light engines 14 has the same apparent brightness, luminance, or radiance, from any angle. With PCB 12 positioned along the bottom interior surface of sidewall 24, light emitted from light engines 14 travels away from PCB 12 across an interior width of channel 22 and may reflect off bottom 26 and/or either sidewall 24 along an interior height of channel 22 before being emitted from encapsulated lighting linear lighting 10. The increased distance travelled by light emitted from light engines 14 improves diffusion of that light so that encapsulated linear lighting 10 appears as a single line of light. Covering 20 may also include additives or other material that enhance diffusion of light emitted from light engines 14.

In addition to improving light diffusion, positioning PCB 12 along the bottom interior surface of sidewall 24 allows other design advantages in encapsulated linear lighting 10. For example, encapsulated linear lighting 10 may provide better diffusion performance as compared with linear lighting in which the light engines are positioned along the centerline of their PCB. Alternatively, linear lighting 10 may be made slightly shorter than conventional linear lighting and offer the same, or about the same, diffusion performance.

The proportions of encapsulated linear lighting 10 need not be what is shown in FIGS. 1-2, and in fact, differences in proportion may be advantageous or may tailor encapsulated linear lighting for particular applications. For example, a narrower channel 22 may improve the flexibility of encapsulated linear lighting 10 in general. A wider channel may enhance light diffusion by increasing the distance light from light engines 14 may travel across the interior of channel 22 prior to being emitted out of encapsulated linear lighting 10.

The height of the channel 22 may be tailored to the width of PCB 12 without the need to provide as much height for diffusion purposes. Additionally, as a general matter, the dimensions of any piece of encapsulated linear lighting 10 may be tailored to fit a specific gap, space, or groove. Regardless of those dimensions, the position of the LED light engines 14 shown in FIGS. 1 and 2 may improve diffusion performance.

Figure 3:
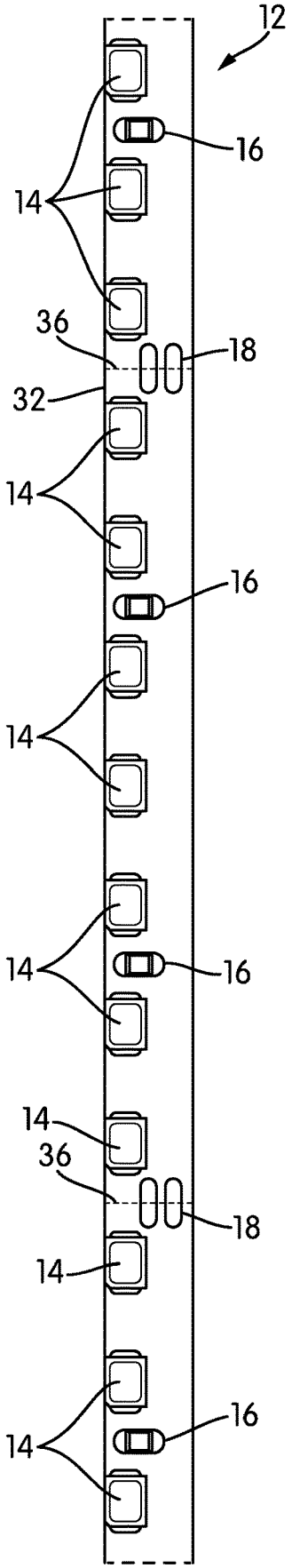
FIG. 3 is a top plan view of a strip of linear lighting according to an embodiment of the invention.

FIG. 3 is a top plan view of a section of PCB 12 in isolation. PCB 12 has a length in a longitudinal direction and a width in a direction perpendicular to the longitudinal direction. In the illustrated embodiment, light engines 14 are positioned off-center on PCB, i.e., positioned away from a center line of PCB 12 extending in the longitudinal direction. In other words, light engines 14 are closer, along the width of PCB 12, to one lateral side 32 than an opposite lateral side 34 of PCB 12. As was explained above, when PCB 12 is encapsulated in the side-bend configuration shown in FIGS. 1 and 2, this may improve diffusion performance.

FIG. 3 indicates a short section of PCB 12. In embodiments of the invention, PCB 12 may be of arbitrary length. A typical PCB of this type is made by surface-mounting components on standard rectangular PCBs and then slicing the rectangular PCB into thin strips. The strips are then connected using overlapping solder joints to form a PCB of arbitrarily long length.

Physically and electrically, PCB 12 is made with a repeating structure. Specifically, it is divided into repeating blocks. Each repeating block is a complete lighting circuit that will light when connected to power. On PCB 12, the repeating blocks are electrically in parallel with one another along the length of PCB 12 and are separable from one another by cut points 36. PCB 12 can be physically cut at a cut point 36 to make it shorter.

In the view of FIG. 3, cut points 36 are marked on the surface of PCB 12 by screen printing or another such method. Cut points 36 are configured to allow a strip of linear lighting to be cut without disrupting a power circuit of the strip of linear lighting. In some cases, cut points 36 may not be marked on PCB 12, although in those cases, the locations of the cut points 36 can usually be discerned using landmarks. One full repeating block is shown in FIG. 3, along with portions of two other repeating blocks. In the illustrated embodiment, cut points 36 pass through and bisect sets of solder pads 18, although other arrangements are possible.

As described above, PCB 12 may include current-setting components 16 as part of the power circuit of PCB 12. Current-setting components 16 may also be positioned off-center on PCB 12. The particular location of current-setting components 16 on PCB 12 is not critical to the invention. On PCB 12, solder pads 18 are positioned closer to opposite lateral side 34. Current-setting components 16, which are resistors in this case, are positioned interstitially between LED light engines 14, but they are closer to opposite lateral side 34 than the light engines 14 themselves.

The width of PCB 12 may also vary from embodiment to embodiment, but does have an influence on the dimensions of the finished encapsulated linear lighting 10. In the illustrated embodiment, PCB 12 may have a width of 6 mm, although PCB widths for linear lighting may range from 5-14 mm. Wider PCB may be helpful if the LEDs are RGB LEDs or other LEDs that require more power and signal conductor lines. Wider PCB may also be helpful if encapsulated linear lighting 10 is longer, in which case the wider PCB allows for more copper in power conductors and thus, potentially, a longer functional maximum length.

In the illustrated embodiment, the power circuit of PCB 12 is designed for connection with a 24V power supply. In other embodiments, the PCB may include a power circuit with electrical components suitable for connection with other types of power supplies. For example, a PCB may be designed for connection to a 12V power supply. In other embodiments a PCB may be designed for connection with a high voltage power supply. Additionally, while current-setting components 16 are shown on PCB 12, nothing prevents other components from being installed. For example, if the LED light engines are RGB light engines, color control components may be installed. At the very least, an RGB light engine typically requires one current-setting component 16 per channel. Wireless transceivers and other, more advanced components may be included as well.

While the invention has been described with respect to certain embodiments, the description is intended to be exemplary, rather than limiting. Modifications and changes may be made within the scope of the invention, which is defined by the appended claims.

What is claimed is:

1. Encapsulated linear lighting, comprising:

a channel including a bottom, a first sidewall, and a second sidewall opposite the first sidewall, an inner surface of the second sidewall extending substantially perpendicular to an inner surface of the bottom;

a strip of linear lighting disposed within the channel, the strip of linear lighting including at least one light engine having a base mounted on the strip of linear lighting, the at least one light engine positioned off-center on the strip of linear lighting, the strip of linear lighting positioned on the first sidewall adjacent to the bottom of the channel such that the at least one light engine is adjacent the bottom of the channel and the base thereof faces the first sidewall; and a covering at least substantially filling the channel so as to encapsulate the strip of linear lighting.

2. The encapsulated linear lighting of claim 1, wherein the at least one light engine is positioned adjacent a lateral side of the strip.

3. The encapsulated linear lighting of claim 1, wherein the strip of linear lighting contacts the bottom of the channel.

4. The encapsulated linear lighting of claim 1, wherein the encapsulated linear lighting is configured as side-bend linear lighting.

5. The strip of linear lighting of claim 1, wherein each sidewall includes an angled top.

6. The encapsulated linear lighting of claim 1, wherein the at least one light engine is configured to emit light that conforms to Lambert's cosine law.

7. The encapsulated linear lighting of claim 1, wherein the covering has a substantially flat top.

8. The encapsulated linear lighting of claim 1, wherein the at least one light engine contacts the bottom of the channel.

9. The encapsulated linear lighting of claim 1, wherein the at least one light engine has a top opposite from the base thereof; and the strip of linear lighting is disposed within the channel such that the top of the at least one light engine faces the second sidewall.

* * * * *